US007398652B1

(12) United States Patent
Kosvic et al.

(10) Patent No.: US 7,398,652 B1
(45) Date of Patent: Jul. 15, 2008

(54) SYSTEM FOR OPTIMIZING A COMBUSTION HEATING PROCESS

(75) Inventors: Tom Kosvic, Deephaven, MN (US); Philip A. Weintz, Chardon, OH (US); Brad Radl, Chardon Township, OH (US); David Wroblewski, Mentor, OH (US); Robert O'Connor, Petersham, MA (US)

(73) Assignee: Pegasus Technologies, Inc., Mentor, OH (US)

( * ) Notice: Subject to any disclaimer, the term of this patent is extended or adjusted under 35 U.S.C. 154(b) by 630 days.

(21) Appl. No.: 10/985,705

(22) Filed: Nov. 10, 2004

(51) Int. Cl.
*F01K 11/00* (2006.01)

(52) U.S. Cl. ..... 60/664; 60/667

(58) Field of Classification Search ..... 60/660, 60/664, 667
See application file for complete search history.

(56) References Cited

U.S. PATENT DOCUMENTS

| | | | | |
|---|---|---|---|---|
| 4,027,145 | A | 5/1977 | McDonald et al. | 235/151.21 |
| 4,705,212 | A * | 11/1987 | Miller et al. | 236/54 |
| 5,027,751 | A | 7/1991 | Archer et al. | 122/449 |
| 5,159,562 | A * | 10/1992 | Putman et al. | 700/288 |
| 5,790,420 | A * | 8/1998 | Lang | 700/287 |
| 2006/0178762 | A1 * | 8/2006 | Wroblewski et al. | 700/30 |

* cited by examiner

*Primary Examiner*—Hoang M Nguyen
(74) *Attorney, Agent, or Firm*—Kusner & Jaffe

(57) ABSTRACT

A system for determining performance characteristics of a combustion heating process. The system uses input parameters that are controllable by an operator or control system to determine a set of controllable loss components. The controllable loss components may be summed to produce an efficiency index value.

38 Claims, 2 Drawing Sheets

SYSTEM FOR OPTIMIZING A COMBUSTION HEATING PROCESS

FIELD OF THE INVENTION

The present invention relates to optimization of a combustion heating process with a variety of fuels, and more particularly to a system for determining performance characteristics of a combustion heating process.

BACKGROUND OF THE INVENTION

Utility companies in the field of electric power generation are being impacted by deregulation and increasing competition. Thus, cost containment and the ability to generate electricity at the lowest possible cost have become increasingly important issues. Improving efficiencies in the electric power generation process can reduce fuel costs, thereby reducing electricity production costs. To this end, improvements in "heat rate" and thermal performance can result in significant fuel cost savings. As used herein, "heat rate" refers to the number of units of total thermal input (i.e., fuel heat input) required to generate a specific amount of electrical energy (i.e., electrical power output). Heat rate provides a measure of thermal efficiency and is typically expressed in units of Btu/kWh in North America. Fuel heat input can be estimated by multiplying the fuel input flow rate times the fuel heat content. Fuels for electric power generation include, but are not limited to, coal, oil, natural gas and other combustible fuels.

In a conventional fossil fuel-fired (e.g., coal-fired) power plant a fossil fuel/air mixture is ignited in a boiler. Large volumes of water are pumped through tubes inside the boiler, and the intense heat from the burning fuel turns the water in the boiler tubes into high-pressure steam. The high-pressure steam from the boiler passes into a turbine comprised of a plurality of turbine blades. Once the steam hits the turbine blades, it causes the turbine to spin rapidly. The spinning turbine causes a shaft to turn inside a generator, creating an electric potential. A combustion turbine can run on natural gas or low-sulfur fuel oil. Air enters at the front of a turbine and is compressed, mixed with natural gas or oil, and ignited. The hot gas then expands through turbine blades to turn a generator and produce electricity. It should be understood that in some boiler configurations, a portion of the generated steam is re-routed to a heat exchanger or to a process. This re-routed steam does not pass through the turbine.

For boilers, there are two primary types of boiler efficiency optimization. The first is the on-going optimization of operation that is primarily under the direction of an operator through operator-controllable input parameters. The second is the periodic optimization that is under the direction of a performance engineer and a maintenance department. Of these two, the on-going optimization by the operator has the potential for a real-time positive impact on the performance of the steam generation unit.

A neural network optimization system requires a goal that is reliable and repeatable. Reliable meaning that a value is not prone to physical faults in the sensing. Repeatable meaning that a given operating point results in the same output. If the goal is better efficiency, then an efficiency-based value is required that is reliable and repeatable. Efficiency is a calculated value from many different sensor inputs. This calculation may require manual input from the operator. Manual inputs must be updated accurately and in a timely fashion or else the result of the calculation will be erroneous.

Existing performance calculations for utility boilers calculate performance based on many parameters from the boiler, turbine, as well as the balance of the power plant. These existing performance calculations are designed to compute an overall efficiency for conversion of coal or gas, or other fuel input into electricity. Plant operators may use performance calculation results to adjust boiler operation, engineers may use performance calculation results to identify performance problems, and plant management may use performance calculation results as a performance evaluation criteria for the facility.

Commonly, a value for heat rate is determined, and used as a performance indicator for a power plant. Input parameters to the existing heat rate calculations are comprised of two groups of parameters. The first set of parameters can be controlled or altered by operators or control systems (i.e., controllable input parameters). The second set of parameters are outside the immediate control or alteration by operators and control systems (i.e., non-controlled input parameters). The non-controlled input parameters include, but are not limited to, fuel composition/quality, equipment condition, weather conditions, extracted steam or energy, non-fuel additives, non-controlled process pressures and pressure imbalances, non-controlled non-compensated fluid flows, non-controlled back pressures or gas stream restrictions, parameters originated at post-combustion equipment (including, but not limited to, Selective Catalytic Reduction (SCR) systems), Fluidized Gas De-Sulphurization (FGD), heat exchangers, and Electrostatic Precipitator (ESP) parameters), originated at pre-combustion equipment (including, but not limited to, coal blending apparatus and fuel analyzer), instrument signal drift, and non-repeatability of sensor inputs.

Calculations of heat rate can be as simple as making an estimate of the fuel heat input (i.e., fuel input flow rate times fuel heat content) and dividing this by the net electrical power output. Calculations for heat rate can also be as complex as doing full heat balances around an entire power plant, utilizing temperatures, pressures, flows, fuel analysis data, flue gas analysis, ash analysis, ambient air analysis (humidity), etc., while also using the net or gross generator electrical output. The computational procedure varies with the amount of detailed information and instrumentation that is available for a particular boiler.

Heat rate is a measure of end-to-end thermal efficiency (related to the reciprocal of the overall thermal efficiency). Most often, the overall thermal efficiency is broken down into terms of boiler efficiency and turbine/generator efficiency. The boiler efficiency rates how much of the input heat is put into heating water, evaporating water and superheating the steam produced, whereas the turbine/generator efficiency rates how effectively the heat captured by steam is converted into electricity.

A common method in the industry for defining boiler efficiency is the ASME losses method, also known as the "heat loss method." The heat loss method accounts for various efficiency losses in the boiler on an individual basis. These losses can usually be quantified by observing a limited number of plant operating parameters.

The current problem with calculating an overall heat rate is that inputs can be noisy, or non-repeatable, making it difficult for calculations that are actionable by operators. Even with time averaging or other statistical manipulation, a typical 10 minute average will often have an error band of +/−2%, which is often greater than the improvements operators or control systems can adjust or resolve. In other words, the signal-to-noise (S/N) ratio presents a difficult situation for evaluation.

The long term, effects of non-controlled input parameters, can make it difficult to ascertain if operators are maintaining good practices for heat rate minimization. For automated systems, such as a combustion optimization system (COS) that automatically tune a combustion environment, these data errors exhibit themselves in poor quality models and in a delay time to take action because of a need to await statistical management of problematic data.

The present invention provides a system for determining performance characteristics based on input parameters that are controllable by an operator or control system (e.g., a combustion optimization system) and can affect overall heat rate.

SUMMARY OF THE INVENTION

In accordance with the present invention, there is provided a system for determining performance characteristics of a combustion heating process in a steam generation system, the system comprising: (a) means for receiving input data indicative of parameters of a steam generation unit that are controllable by at least one of (1) an operator of the combustion heating process and (2) a computer control system; (b) means for determining a plurality of controllable loss components in accordance with said received input data; and (c) means for determining an efficiency reference index by summing said plurality of controllable loss components.

In accordance with another aspect of the present invention, there is provided a method for determining performance characteristics of a combustion heating process in a steam generation system, the method comprising: (a) receiving input data indicative of parameters of a steam generation unit that are controllable by at least one of (1) an operator of the combustion heating process and (2) a computer control system; (b) determining a plurality of controllable loss components in accordance with said received input data; and (c) determining an efficiency reference index by summing said plurality of controllable loss components.

An advantage of the present invention is the provision of a system for determining performance characteristics of a combustion heating process that uses the effects of input parameters that are controllable by an operator or control system.

Another advantage of the present invention is the provision of a system for determining performance characteristics of a combustion heating process that provides increased resolution of the output parameters.

Another advantage of the present invention is the provision of a system for determining performance characteristics of a combustion heating process that can be used for improved real-time control purposes.

Still another advantage of the present invention is the provision of a system for determining performance characteristics of a combustion heating process that can provide real-time performance improvements in the combustion heating process.

Still another advantage of the present invention is the provision of a system for determining performance characteristics of a combustion heating process, that can determine controllable losses with higher resolution.

Still another advantage of the present invention is the provision of a system for determining performance characteristics of a combustion heating process that can optimize combustion and heat absorption, through the manipulation of site-specific control variables.

Yet another advantage of the present invention is the provision of a system for determining performance characteristics of a combustion heating process that uses a real-time performance index value that is indicative of boiler and steam generation performance.

Yet another advantage of the present invention is the provision of a system for determining the fuel being consumed and the use of its characteristics as a real-time factor in efficiency index calculations.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF A PREFERRED EMBODIMENT

Figure 1:
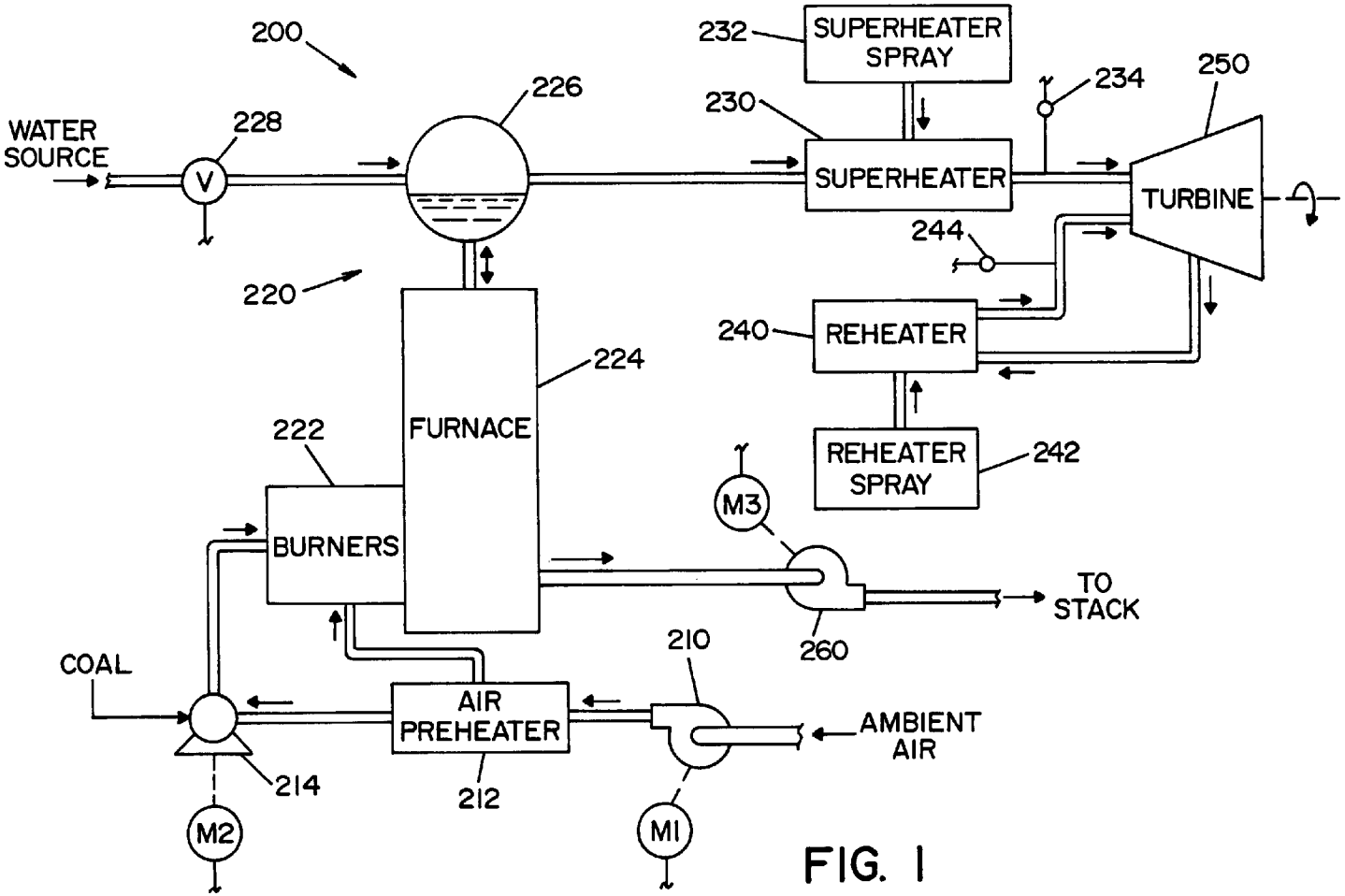
FIG. 1 is a simplified schematic block diagram of a typical power generating unit, including a steam generating system.

Referring now to the drawings wherein the showings are for the purposes of illustrating a preferred embodiment of the invention only and not for the purposes of limiting same, FIG. 1 is a simplified schematic of a typical power generating unit 200. It should be appreciated that while a preferred embodiment of the present invention is described with reference to a power generating unit that uses coal, the present invention is applicable to power generating units using other combustible fuels. Unit 200 includes one or more forced draft (FD) fans 210 that are powered by motors M1. Forced draft fans 210 supply air to mills 214 and to burners 222, via an air preheater 212. Ambient air is heated as it passes through air preheater 212.

Mills 214 include pulverizers that are powered by motors M2. The pulverizers grind coal (or other fuel) into small particles (i.e., powder). The air received by mills 214 from forced draft fans 210 is used to dry and carry the coal particles to burners 222. Air from forced draft fans 210 that is supplied to burners 222, via air preheater 212, facilitates combustion of the coal at furnace 224.

Hot flue gases are drawn out of furnace 224 by one or more induced draft fans 260, and delivered to the atmosphere though a stack or chimney. Induced draft (ID) fans 260 are powered by motors M3.

Water is supplied to a drum 226 by control of a feedwater valve 228. The water in drum 226 is heated by furnace 224 to produce steam. This steam is further heated by a superheater 230. A superheater spray unit 232 can introduce a small amount of water to control the temperature of the superheated steam. A temperature sensor 234 provides a signal indicative of the sensed temperature of the superheated steam. The superheated steam is supplied to a turbine 250 that produces electricity.

Steam received by turbine 250 is reused by circulating the steam through a reheater 240 that reheats the steam. A reheater spray unit 242 can introduce a small amount of water to control the temperature of the reheated steam. A temperature sensor 234 provides a signal indicative of the sensed temperature of the reheated steam.

A boiler 220 is generally comprised of burners 222, furnace 224, drum 226, superheater 230, superheater spray unit 232, reheater 240 and reheater spray unit 242.

It should be appreciated that FIG. 1 is a simplified schematic of a typical power generating unit 200, and that power generating unit 200 also includes additional components well known to those skilled in the art, including additional sensing devices for sensing a wide variety of system parameters.

Figure 2:
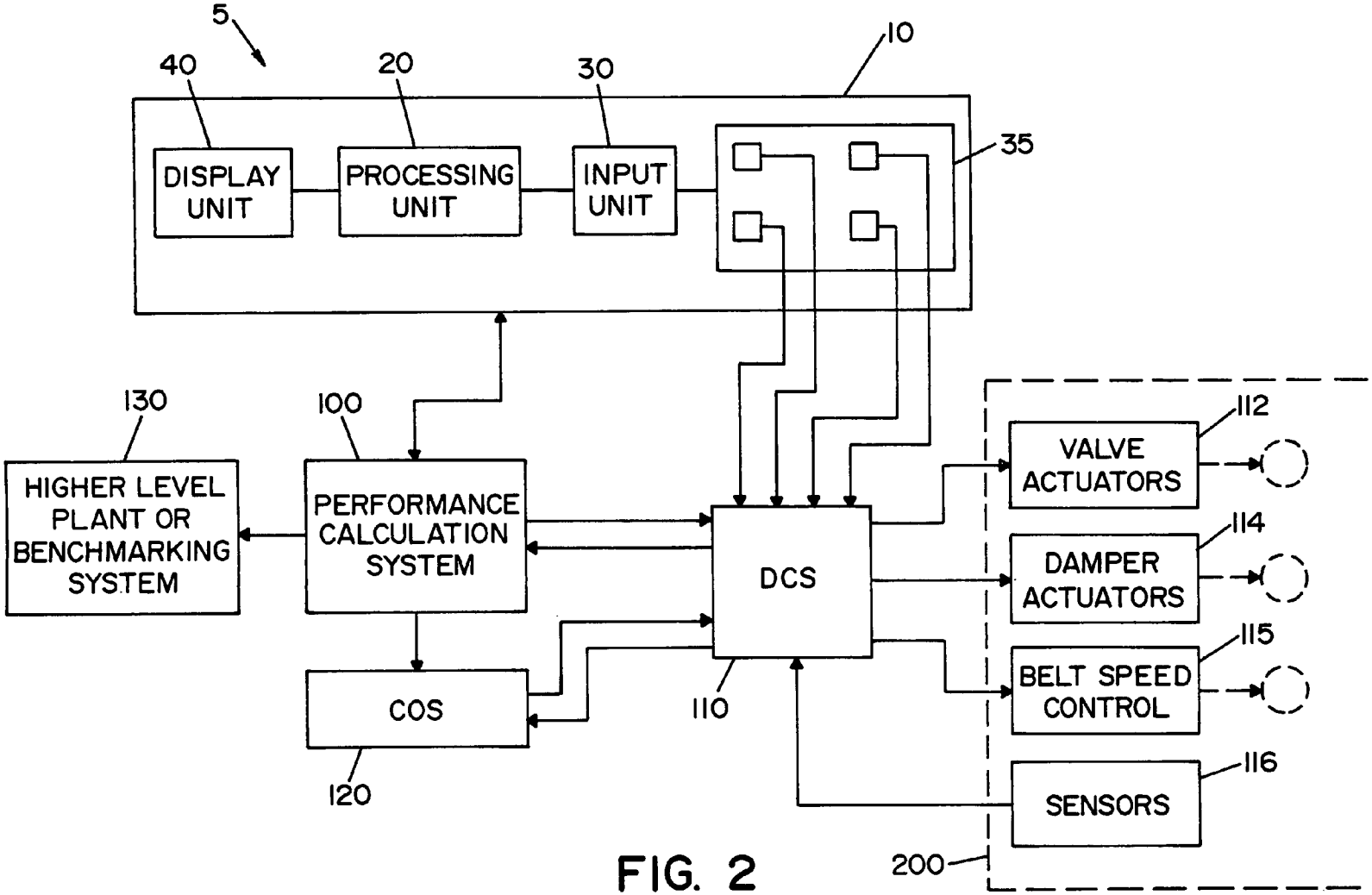
FIG. 2 is a block diagram of a system for operating an electric power generating plant that uses a combustible fuel to produce heat for a boiler.

FIG. 2 shows a system 5 for operating an electric power generating plant that uses a combustible fuel to produce heat for a boiler (not shown). It should be appreciated that other types of steam generation systems may be used in connection with the present invention. System 5 includes an operator control system 10, a performance calculation system 100, a distributed control system (DCS) 110, a combustion optimization system (COS) 120, and a higher level plant or benchmarking system 130.

Operator control system 10 includes a processing unit 20, an input unit 30 and a display unit 40. Processing unit 20 may take the form of a conventional microprocessor, microcontroller or personal computer. Input unit 30 includes a keyboard, pointing input device (e.g., a mouse) and a plurality of operator controls 35 (e.g., switches or electronic button controls). Operator controls 35 provide input signals to DCS 110. Display unit 40 may take the form of a video monitor display and/or printer.

Performance calculation system 100 is a computer system that determines controllable loss components for steam generation. These controllable loss components are summed to produce an "efficiency reference index" (ERI), as will be explained in detail below. System 100 may include a graphical user interface (GUI) for convenient entry and display of data. The GUI is displayed to an operator using display unit 40. The GUI preferably provides means for customizing system 100.

DCS 110 is a computer system that provides control of the combustion process by operation of system devices, including, but not limited to, valve actuators 112 for controlling water and steam flows in unit 200, damper actuators 114 for controlling air flows in unit 200, and belt-speed control 115 for controlling flow of coal to mills 214. DCS 110 also provides input parameters to performance calculation system 100. Sensors 116 (including, but not limited to, oxygen analyzers, thermocouples, resistance thermal detectors, pressure sensors, and differential pressure sensors) sense parameters associated with the boiler and provide input signals to DCS 110.

COS 120 is a computer system that optimizes the combustion process by optimizing air flows, fuel flows, distributions, pressures, air/fuel temperatures and heat absorption, to achieve optimal combustion conditions. The output data of COS 120 (i.e., the control value recommendations) is received by DCS 110 to provide real-time optimal control of the combustion process. Accordingly, fuel blending systems, scrubbers, SCR systems, sootblowing, and the like, can also be optimized.

Higher level plant or benchmarking system 130 refers to any system that may be considered a lower sub-system, a peer-to-peer system, or a higher level system. The ERI value and/or controllable loss component values may be transmitted to higher level plant or benchmarking system 130, as well as other systems not shown herein.

Higher level plant or benchmarking system 130 may take the form of a plant level system that receives data from multiple performance calculation systems 100 associated with different power generating units. The combined ERI and plant information may then be used for actions taken upon these individual power generating units. Examples of possible decisions include, but are not limited to, power dispatching between power generating units, fuel allocation, and byproduct production optimization (including pollution emissions system action). Furthermore, historical ERI and controllable loss component values, current ERI and controllable loss component values, or predicted ERI and controllable loss component values may be used to influence decisions and performance of other systems.

The present invention will now be described with reference to boilers used in a conventional coal-fired power plant. As indicated above, system 100 determines controllable loss components for steam generation. These controllable loss components are summed to produce an "efficiency reference index" (ERI). The ERI can be used to compute "heat rate losses" (i.e., an ERI value in "heat rate" units) in the boiler. These heat rate losses represent the controllable losses that can be affected by an operator or by a control system (e.g., an optimization system). By lowering the heat rate losses, the overall heat rate of a steam generation unit can be improved. Unlike a conventional boiler efficiency calculation, the ERI also includes the effect of superheat and reheat temperatures along with the associated losses from superheat and reheat spray flows, as will be described in detail below.

The controllable loss components are the output parameters of system 100, and may include, but are not limited to: (1) Dry Gas Loss, (2) Superheat (SH) Temperature Loss, (3) Reheat (RH) Temperature Loss, (4) Superheat (SH) Spray Flow Loss, (5) Reheat (RH) Spray Flow Loss, (6) Auxiliary Power Energy Loss, and (7) Carbon Loss (i.e., Unburned Carbon in Ash). It should be understood that not all of the above-identified controllable loss components will be applicable in all situations.

The Dry Gas Loss factor is determined by calculating the total stack gas thermal mass flow energy loss. Stack gas thermal flow energy loss is defined by the ASME PTC-4-1998 code book as the enthalpy (specific energy, that is, energy per unit mass) of dry gas at the temperature leaving the boundary corrected for air leakage (excluding leakage). Stack gas mass flow is defined by the ASME PTC-4-1998 code book as the mass of the dry gas flow exiting the boundary based on excess air. If there is additional dry gas loss due to air infiltration that shall be included in the amount as a measured amount or as a design or engineering estimated constant.

The Stack gas mass flow and gas thermal change (i.e., temperature delta) are multiplied to calculate the Dry Gas Loss. That is to say, the gas mass flow is multiplied by the thermal change to yield the total Dry Gas Loss. The stack gas mass flow is calculated as a function of the fuel analysis, the oxygen measurement, stack gas flow, and the stack final gas outlet temperature. Additionally, calculations within the whole of the program determine the type of fuel burning at any particular time, and the associated fuel analysis is used for these dry gas loss factor calculations.

The superheat (or throttle) temperature has a design target value. There is an efficiency penalty for being below the design target value and an efficiency credit for being above the design target value. The associated penalties and credits vary by the offset from target and by the unit load. Therefore, the penalty or credit for temperature excursions away from the design target value are easily conveyed in a two dimensional curve. A preferred embodiment of the present invention obtains the current penalty or credit from the curve and converts it to units of Btu/kWhr.

The reheat temperature has a design target value. There is an efficiency penalty for being below the design target value and an efficiency credit for being above the design target value. The associated penalties and credits vary by the offset from target and by the unit load. Therefore, the penalty or credit for temperature excursions away from the design target value are easily conveyed in a two dimensional curve. A preferred embodiment of the present invention obtains the current penalty or credit from the curve and converts it to units of Btu/kWhr.

The superheat and reheat spray flows have a penalty associated with their use. The penalty varies as to the amount of spray and the current load on the boiler. Therefore, it is easiest to represent these penalties as curves. The subsequently retrieved penalty factor is then converted to units of Btu/kWhr.

Any power consumed by motors in the steam generation unit is considered a loss. However, only large motors contribute significantly to this loss, and therefore are the only ones that need to be considered in the calculations. These calculations compute power as a function of motor ampere inputs, or they can take in the directly measured motor power. The resultant total power of all configured motors is subsequently converted to units of Btu/kWhr.

The carbon loss value is composed of two associated values. The first value is the loss due to carbon monoxide formation upon combustion. The second value is the unburned carbon in ash loss. These two loss values are added and converted to units of heatrate.

It should be understood that a penalty for not being at a design target value can be positive or negative. In some circumstances, a condition that provides a benefit (i.e., a positive penalty) has other undesirable consequences (e.g., exceeding a manufacturers rating). It should also be understood that a "loss" can be positive under some circumstances (i.e., a credit rather than a loss).

The controllable input parameters (with associated abbreviations) identified in the table below are used by system 100 to determine values for the controllable loss components, discussed above.

| INPUT PARAMETERS | ABBREVIATION | DEFINITION |
|---|---|---|
| % Carbon in fuel (percent) | % C | Percent carbon as reported by a laboratory analysis, in accordance with the appropriate ASTM or other recognized standard, of a fuel sample providing the mass percentage of carbon. |
| % Hydrogen in fuel (percent) | % H | Percent hydrogen as reported by a laboratory analysis, in accordance with the appropriate ASTM or other recognized standard, of a fuel sample providing the mass percentage of hydrogen. |
| % Oxygen in fuel (percent) | % O | Percent oxygen as reported by a laboratory analysis, in accordance with the appropriate ASTM or other recognized standard, of a fuel sample providing the mass percentage of oxygen. |
| % Nitrogen in fuel (percent) | % N | Percent nitrogen as reported by a laboratory analysis, in accordance with the appropriate ASTM or other recognized standard, of a fuel sample providing the mass percentage of nitrogen. |
| % Sulfur in fuel (percent) | % S | Percent sulfur as reported by a laboratory analysis, in accordance with the appropriate ASTM or other recognized standard, of a fuel sample providing the mass percentage of sulfur. |

-continued

| INPUT PARAMETERS | ABBREVIATION | DEFINITION |
|---|---|---|
| % Ash in fuel (percent) | % Ash | Percent ash as reported by a laboratory analysis, in accordance with the appropriate ASTM or other recognized standard, of a fuel sample providing the mass percentage of ash. |
| % Water in fuel (percent) | % H2O | Percent water as reported by a laboratory analysis, in accordance with the appropriate ASTM or other recognized standard, of a fuel sample providing the mass percentage of water. |
| Carbon in bottom ash (percent) | C_in_bottom_ash | Carbon in all residue removed from the combustion chamber, other than that entrained in the flue gas. |
| Fly ash in total ash (percent) | fly_ash_in_total_ash | Particles of residue entrained in the flue gas leaving the steam generator boundary as a percentage of total ash. |
| Carbon in fly ash (percent) | C_in_fly_ash | Combustible matter constituent of fuel that is resident in fly ash. |
| Measured $O_2$ (percent) | measure_O2 | The oxygen component measured in the post combustion region of the boiler. |
| $O_2$ measurement as wet or dry basis (0 or 1) | O2 wet_or_dry_basis | The measured oxygen ($O_2$) with or without compensation for $H_2O$ as determined by the instrument measurement and method used. |
| Humidity (absolute humidity not relative) (moles $H_20$/moles dry air) | humidity | Mass of water vapor present in unit volume of the atmosphere. |
| Ambient temperature (degree F.) | ambient_temp | The measurement of the external air temperature brought into the process. |
| Higher Heating Value (Btu/lb) | HHV | The total energy liberated per unit mass of fuel upon complete combustion, as determined by the appropriate ASTM standards. |
| Gross MW (MW) | Gross_MW | The amount of electrical generation being produced at the output of the turbine, measured in millions of watts. |
| Fuel flow (lbs/hr) | Fuel_flow | The current amount of fuel being feed into the steam generator. |
| Max Gross Load (MW)-plant design maximum | Max_Gross_Load | The electrical generation that corresponds to the maximum main steam flow (defined below). |
| Superheat Temperature Desired (degree F.) - plant design maximum | SH_Temp_Desired | Boiler manufacturer designed/redesigned main steam temperature. |
| Superheat Temperature (degree F.) - actual | SH_Temp | Actual main steam temperature. |
| Reheat Temperature Desired (degree F.) - plant design maximum | RH_Temp_Desired | Boiler manufacturer designed/redesigned target temperature of the steam which has been returned to the boiler for additional heating by the gas stream. |
| Reheat Temperature (degree F.) - actual | RH_Temp | Actual temperature of the steam which has been returned to the boiler for additional heating by the gas stream. |
| Baseline Heat Rate (Btu/KW) - plant design maximum | Baseline_Heat_Rate | Plant designed/redesigned fuel heat input required to generate a kwhr. |

-continued

| INPUT PARA-METERS | ABBREVIA-TION | DEFINITION |
|---|---|---|
| Maximum Steam Flow (Klbs/hr) | Max_Steam_Flow | The maximum main steam mass flow rate that the steam generator is capable of producing on a continuous basis with specified steam conditions and cycle configuration. |
| Superheat Steam Flow (Klbs/hr) | SH_Steam_Flow | Measured flow of the main steam. |
| Superheat Spray Flow (lbs/hr) | SH_Spray_Flow | Measured flow of the water that is sprayed into the superheat section in order to control superheat temperature. |
| Reheat Spray Flow (lbs/hr) | RH_Spray_Flow | Measured flow of the water that is sprayed into the reheat section in order to control reheat temperature. |
| Total Mill Amps (computed by adding mill amps) (Amps) | Total_Mill_Amp | The total measured amperes of the mill motors. |
| Mill Volts (Volts) | Mill_Volts | The voltage of the mill motors (total). |
| Total FD Fan Amps (computed by summing FD fan amps) (Amps) | Total_FD_Fan_Amps | The total measured amperes of the forced draft fan motors. |
| FD Fan Volts (Volts) | FD_Fan_Volts | The voltage of the forced draft fan motors. |
| Total ID Fan Amps (computed by summing ID fan amps) (Amps) | Total_ID_Fan_Amps | The total measured amperes of the induced draft fan motors. |
| ID Fan Volts (Volts) | ID_Fan_Volts | The voltage of the induced draft fan motors. |
| Measured Carbon Monoxide | co_fg | The carbon monoxide component measured in the post combustion region of the boiler. If undefined a constant is substituted. |
| Air Preheater Flue Gas Outlet Temperature | Aph_out_temp | The temperature of the gas flowing to the stack. |

It should be understood that if an input parameter is not directly available in appropriate units, system 100 is programmed to convert to the proper units.

Some input parameter are input to system 100 from DCS 110, while other input parameters may be manually configured into system 100 using input unit 30 of operator control system 10. For example, input parameters such as % Carbon in fuel, % Hydrogen in fuel, % Oxygen in fuel, % Nitrogen in fuel, % Sulfur in fuel, % Ash in fuel, and % Water in fuel are typically found in fuel analysis supplied to a power plant from a lab, and are thus manually configured into system 100.

The table set forth below identifies the input parameters used by system 100 to determine each controllable loss component.

| Controllable Loss Components | Input Parameters |
|---|---|
| Dry Gas Loss | % C, % H, % O, % N, % S, % Ash, % H20, C_in_bottom_ash, fly_ash_in_total ash, C_in_fly_ash, measure_O2, co_fg, O2_wet_or_dry_basis, humidity, aph_out_temp, ambient_temp, HHV Gross_MW, Fuel_flow |
| SH Temp Loss/Credit | Max_Gross_Load, SH_Temp_Desired, SH_Temp, Gross_MW |
| RH Temp Loss/Credit | Max_Gross_Load, RH_Temp_Desired, RH_Temp, Gross_MW |
| SH Spray Flow Loss | Baseline_Heat_Rate, Max_Steam_Flow, SH_Steam_Flow, SH_Spray_Flow |
| RH Spray Flow Loss | Baseline_Heat_Rate, Max_Steam_Flow, SH_Steam_Flow, RH_Spray_Flow |
| Aux Power Losses | Total_Mill_Amp, Mill_Volts, Total_FD_Fan_Amps, FD_Fan_Volts, Total_ID_Fan_Amps, ID_Fan_Volts |
| Unburned Carbon in Ash | % Ash, C_in_bottom_ash, fly_ash_in_total ash, C_in_fly_ash, HHV, Gross_MW, Fuel_flow |

Calculation of "Controllable Loss Components" used to determine ERI will now be described in detail.

Dry Gas Loss (using reference fuel constituent values (constants) for the type of fuel being burned) is determined as follows:

(1) calculating an Adjusted Effective Carbon Fraction Burned.

(2) calculating the amount of $O_2$ required to produce a "zero excess air" condition (expressed in moles of $O_2$ required per 100 lbs. of fuel).

(3) using an iterative calculation to determine the amount of $O_2$ (expressed in moles of $O_2$ per 100 lbs. of fuel) in the flue gas at the measured excess $O_2$ level.

(4) calculating the actual flue gas composition by volume (i.e., moles of primary elements) for the measured and reference $O_2$ level.

(5) calculating the individual "dry" component losses on a per component basis (e.g., $CO_2$ loss, $SO_2$ loss, $N_2$ loss, and $O_2$ loss). The "wet" component losses are calculated simultaneously, but are a configurable option to be used in the dry gas loss calculation.

(6) measuring stack gas temperature to establish a reference stack gas temperature.

(7) summing the individual "dry" component losses to produce a dry gas loss baseline value (typically representing about a 5% loss on boiler efficiency, or roughly equivalent to 500 Btu/kWhr.

(8) Utilizing excess $O_2$ values to determine a reduction/increase in mass flow of air by using the value as the determination of excess air. Stack gas temperature is used to determine the reduction/increase in heat input into the stack air.

Dry Gas Loss Calculations

```
/* Calculate an Adjusted Effective Carbon Fraction Burned. */
c_pct_in_totl_ash = C_in_fly_ash * fly_ash_in_total_ash / 100.
    +(C_in_bottom_ash * (1.0 - fly_ash_in_total_ash / 100.))
c_unburn_in_totl_ash = %Ash * c_pct_in_totl_ash / (100. - c_pct_in_totl_ash)
```

c_unburn_in_CO = co_fg * 1.e−06 * 12./ 29. * (1. + 8.) * 100.

(co_fg can be a measured input, or a constant value of 10.0 may be used.)

/* Combustion Calculations of Required $O_2$ at Zero Excess Air.*/ c_to_co2_reqd_O2 = (%C − c_unburn_in_totl_ash − c_unburn_in_CO) / 12. * 1.0 c_to_co_reqd_O2 = c_unburn_in_CO / 12. * 0.5 co_to_co2_reqd_O2 = 0.0 c_unburn_reqd_O2 = 0.0 h2_fuel_to_h20_reqd_O2 = %H / 2. * 0.5 s_to_so2_reqd_O2 = %S / 32.

o2_fuel_deduct_reqd_O2 = −1. * %O / 32. * 1.0 n2_fuel_reqd_O2 = 0.0 co2_fuel_reqd_O2 = 0.0 h20_fuel_reqd_O2 = 0.0 ash_fuel_reqd_O2 = 0.0 sum_reqd_O2 _zero_excess = c_to_co2_reqd_O2 + c_to_co_reqd_O2 + co_to_co2_reqd_O2 + c_unburn_reqd_O2 + h2_fuel_to_h20_reqd_O2 + s_to_so2_reqd_O2 + o2_fuel_deduct_reqd_O2 + n2_fuel_reqd_O2 + co2_fuel_reqd_O2 + h20_fuel_reqd_O2 + ash_fuel_reqd_O2

/* Setup for Iterative Calculation to Determine Moles of $O_2$ */

/* in Flue Gas at Measured Boiler Excess $O_2$. */ co2_moles_from_unburn_C = 0.0 co2_moles_from_CO = 0.0 co2_moles_from_C = (%C − c_unburn_in_totl_− c_unburn_in_CO) / 12.

co_moles_measured = c_unburn_in_CO / 12.

so2_moles_from_S = %S/ 32.

n2_moles_from_reqd_O2 = sum_reqd_O2 _zero_excess * 3.76

(At this stage of the calculations, quantities of the following elements are determined iteratively: excess_o2_moles, excess_n2_moles.)

/* Calculate moles of primary elements. */ co2_moles_fg = co2_moles_from_C + co2_moles_from_CO + co2_moles_from_unburn_C co_moles_fg = co_moles_measured o2_moles_fg = excess_o2_moles so2_moles fg = so2_moles_from_S n2_moles_fg = n2_moles_from_reqd_O2 + excess_n2_moles /* Calculate Boiler Efficiency Losses. */ co2_cp_mean = (0.1930810511 + 0.0001018506392 * aph_out_temp + (−2.000052653e−08 * aph_out_temp * aph_out_temp)) * 48.0 so2_cp_mean = (0.1452411551 + 3.952004494e−05 * aph_out_temp + (−8.6968885297e−09 * aph_out_temp * aph_out_temp)) * 64.0 o2_cp_mean = (0.2163745278 + 4.168666821e−05 * aph_out_temp + (−6.536972164e−09 * aph_out_temp * aph_out_temp)) * 32.0 n2_cp_mean = (0.2468951415 + 1.156388560e−05 * aph_out_temp + (8.844169114e−09 * aph_out_temp * aph_out_temp)) * 28.0 h2o_cp_mean = (0.4275771771 + 8.676216148e−05 * aph_out_temp + (−1.457839088e−09 * aph_out_temp * aph_out temp))* 18.0 co_cp_mean = (0.2467039534 + 1.790959967e−05 * aph_out_temp + (6.669466889e−09 * aph_out_temp * aph_out_temp)) * 28.0 co2_heat_loss = co2_moles_fg * co2_cp_mean * (aph_out_temp − ambient_temp)

so2_heat_loss = so2_moles_fg * so2_cp_mean * (aph_out_temp − ambient_temp)

o2_heat_loss = o2_moles_fg * o2_cp_mean * (aph_out_temp − ambient_temp)

n2_heat_loss = n2_moles_fg * n2_cp_mean * (aph_out_temp − ambient_temp)

co_heat_loss = co_moles_fg * co_cp_mean * (aph_out_temp − ambient_temp)

dry_gas_heat_loss = co2_heat_loss + so2_heat_loss + o2_heat_loss + n2_heat_loss + co_heat_loss /* Compute percent dry gas loss. */ dry_gas_loss_pct = dry_gas_heat_loss * 100./ (HHV * 100.)

/* Calculate Dry Gas Loss as Heat Rate Deviation Factor (i.e., convert loss to "heat rate" units). */ dry_gas_loss_hrdev = dry_gas_loss_pct / 100. * Fuel_flow * HHV/ Gross_MW/ 1000.

Superheat (SH) Temperature Loss/Credit is determined by:

(1) calculating the load factor;

(2) calculating the Superheat (SH) temperature deviation factor;

(3) calculating the loss/credit fraction; and (4) converting the loss/credit fraction to heat rate deviation units.

SH Temp Loss/Credit Calculations

/* Calculate the load factor. */ load_factor = Gross_MW / Max_Gross_Load

/* Calculate the SH temp deviation factor. */ sh_temp_deviation = SH_Temp − SH_Temp_Desired

/* Calculate loss/credit fraction. */ sh_temp_slope = 0.01173333333 + 0.004266666667 * load_factor * load_factor sh_temp_hr_chng_fract = −1.0 * sh_temp_slope * sh_temp_deviation / 100.0

/* Convert loss/credit fraction to heat rate deviation units.*/ sh_temp_hrdev = sh_temp_hr_chng_fract * Baseline_Heat_Rate

The Reheat (RH) Temperature Loss/Credit is determined by:

(1) calculating the load factor;

(2) calculating the Reheat (RH) temperature deviation factor;

(3) calculating the loss/credit fraction; and (4) converting the loss/credit fraction to heat rate deviation units.

RH Temp Loss/Credit Calculations

/* Calculate the load factor. */ load_factor = Gross_MW / Max_Gross_Load

/* Calculate the RH temp deviation factor. */ rh_temp_deviation = RH_Temp − RH_Temp_Desired

/* Calculate loss/credit fraction. */ rh_temp_slope = 0.03266666667 + −0.0400000000* load_factor 0.021333333333* load_factor * load_factor rh_temp_hr_chng_fract = −1.0* rh_temp_slope * rh_temp_deviation / 100.0

/* Convert loss/credit fraction to heat rate deviation units. */ rh_temp_hrdev = rh_temp_hr_chng_fract */ Baseline_Heat_Rate

The Superheat (SH) Spray Flow Loss is determined by:

(1) calculating the percent maximum throttle flow;

(2) calculating the percent spray flow of the main steam flow;

(3) calculating the loss fraction; and (4) converting the loss fraction to heat rate deviation units.

SH Spray Flow Loss Calculations

/* Calculate % maximum throttle flow. */
sh_flow_pct = SH_Steam_Flow / Max_Steam_Flow * 100.
/* Calculate % spray flow of main steam flow. */
sh_pct_corr_pct_spray = 0.01857142857 + −7.142857143e−0006 * sh_flow_pct + 7.142857143e−0007 * sh_flow_pct * sh_flow_pct
sh_spray_flow_pct = SH_Spray_Flow / Max_Steam_Flow * 100
sh_spray_flow_chng_fract = sh_spray_flow_pct * sh_pct_corr_pct_spray / 100.
/* Convert loss to heat rate deviation units. */
sh_spray_flow_hrdev = sh_spray_flow_chng_fract * Baseline_Heat_Rate The Reheat (RH) Spray Flow Loss is determined by:

(1) calculating the percent maximum throttle flow;

(2) calculating the percent spray flow of the main steam flow;

(3) calculating the loss fraction; and (4) converting the loss fraction to heat rate deviation units.

RH Spray Flow Loss Calculations

/* Calculate % maximum throttle flow. */
rh_flow_pct =RH_Steam_Flow / Max_Steam_Flow * 100.
/* Calculate % spray flow of main steam flow. */
rh_pct_corr_pct_spray = 0.1085714286 + −0.0002071428571 * rh_flow_pct + 1.071428571e−0005 * rh_flow_pct * rh_flow_pct
rh_spray_flow_pct = RH_Spray_Flow / Max_Steam_Flow * 100
rh_spray_flow_chng_fract = rh_spray_flow_pct * rh_pct_corr_pct_spray / 100.
/* Convert loss to heat rate deviation units. */
rh_spray_flow_hrdev = rh_spray_flow_chng_fract * Baseline_Heat_Rate Note: 0.85 (85%) may be used as a correction factor.

The Auxiliary Power Loss is determined by:

(1) calculating the power consumed by each motor;

(2) calculating a single motor power value for all of the motors; and (3) converting the loss to heat rate deviation units.

Auxiliary Power Loss Calculations

/* Calculate the power consumed by each motor. */
motor_power = motor_amps * motor_volts
(The preceding calculation is repeated for each motor (mill and fan)).
(All of the computed motor power values are summed into a single motor power value (e.g., motor_power_all).
/* Convert this loss to heat rate deviation units. */
aux_power_hrdev = motor_power_all / Gross_MW * 3.1413e−03

The Unburned Carbon in Ash (i.e., Carbon Loss) is determined by:

(1) calculating unburned carbon fraction burned; and (2) converting the loss to heat rate deviation units.

Unburned Carbon in Ash (i.e., Carbon Loss) Calculations

/* Calculate an Adjusted Effective Carbon fraction Burned. */
c_pct_in_totl_ash = C_in_fly_ash * fly_ash_in total_ash / 100.
+ (C_in_bottom_ash * (1.0 − fly_ash_in_total_ash / 100.))
c_unburn_in_totl_ash = %Ash * c_pct_in_totl_ash / (100. − c_pct_in_totl_ash)
c_heat_loss_in_ash = c_unburn_in_totl_ash * 14550.
c_heat_loss_in_ash_pct = c_heat_loss_in_ash * 100. (HHV * 100.)
/* Convert this loss to heat rate deviation units. */
c_heat_loss_in_ash_hrdev = c_heat_loss_in_ash_pct / 100. * Fuel_Flow * HHV / Gross_MW / 1000.

As indicated above, an Efficiency Reference Index (ERI) is determined by summing the values of each controllable loss component discussed above.

The determined ERI value can be output to display unit 40 to provide a graphical display of data, may be output to Combustion Optimization System 120 for determining the best combination of air flows (e.g. primary air flow to mills 214, secondary air flow to a windbox, and windbox delta-pressure), fuel flows, or other control signals (e.g., speed/damper control of forced draft fans 210). The Combustion Optimization System 120, in turn, determines an optimal configuration that allows the greatest reduction in controllable loss components, or in other words, the most favorable ERI value. The ERI value may then be output to a first principle model, or a neural network model for optimizing combustion that is interrogated by a variety of different optimizers (e.g., Guided Evolutionary Search Algorithm (GESA), gradient descent algorithm, etc.). The ERI value can also be output directly to DCS 110.

It should be appreciated that the ERI can be used as a benchmarking tool for comparison of multiple steam generation units or comparison of factors within a single steam generation unit (e.g., comparison of a first shift of operators vs. a second shift of operators). The controllable input parameters contributing to the calculations within the ERI, while interdependent (for example, raising $O_2$, may raise or lower the RH temperature), have specific heat rate costs associated with them. Each power plant can have an ideal setting or limit. For example, $O_2$ as a general statement could have a baseline at 2%. The Reheat Spray Flows may be benchmarked at an ideal control target of 10% of spray flow, etc. These are judgments that can be configured within or for a group of power plants, either on the same site, same utility or any general grouping. The ERI can measure the overall index of performance with regards to keeping a comparison of performance.

Other modifications and alterations will occur to others upon their reading and understanding of the specification. It is intended that all such modifications and alterations be included insofar as they come within the scope of the invention as claimed or the equivalents thereof.

Having described the invention, the following is claimed:

1. A system for determining performance characteristics of a combustion heating process in a steam generation system, the system comprising:

means for receiving input data associated with controllable input parameters of the steam generation system, wherein said controllable input parameters are parameters controlled by at least one of (1) an operator of the combustion heating process and (2) a computer control system;

means for determining a plurality of controllable loss components using the input data associated with the controllable input parameters, said controllable loss components determined in accordance with said received input data; and means for determining an efficiency reference index by summing said plurality of controllable loss components; and means for outputting the determined efficiency reference index to a combustion optimization system, wherein the combustion optimization system uses the efficiency reference index to determine optimized control values for optimizing the combustion heating process.

2. A system according to claim 1, wherein said input data associated with the controllable input parameters is selected from the group consisting of:

% carbon in fuel, % hydrogen in fuel, % oxygen in fuel, % nitrogen in fuel, % sulfur in fuel, % ash in fuel, % water in fuel, carbon in bottom ash (percent), fly ash in total ash (percent), carbon in fly ash (percent), measured $O_2$ (percent), $O_2$ measurement as wet or dry basis, absolute humidity, air preheater flue gas outlet temperature, ambient temperature, higher heating value, gross mw, fuel flow, max gross load, desired superheat temperature, actual superheat temperature, desired reheat temperature, actual reheat temperature, baseline heat rate, maximum steam flow, superheat steam flow, superheat spray flow, reheat spray flow, total mill amperage, mill volts, total forced draft fan amperage, forced draft fan volts, total induced draft fan amperage, and induced draft fan volts.

3. A system according to claim 1, wherein said plurality of controllable loss components are selected from the group consisting of: Dry Gas Loss, Superheat (SH) Temperature Loss/Credit, Reheat (RH) Temperature Loss/Credit, Superheat (SH) Spray Flow Loss, Reheat (RH) Spray Flow Loss, Auxiliary Power Energy Loss, and Carbon Loss.

4. A system according to claim 3, wherein said dry gas loss is determined as a function of % carbon in fuel, % hydrogen in fuel, % oxygen in fuel, % nitrogen in fuel, % sulfur in fuel, % ash in fuel, % water in fuel, carbon in bottom ash (percent), fly ash in total ash (percent), carbon in fly ash (percent), measured $0_2$ (percent), $0_2$ measurement as wet or dry basis, humidity, air preheater flue gas outlet temperature, ambient temperature, higher heating value, gross MW, and fuel flow.

5. A system according to claim 3, wherein said Superheat (SH) Temperature Loss is determined as a function of Max Gross Load, Gross MW, desired superheat temperature, and actual superheat temperature.

6. A system according to claim 3, wherein said Reheat (RH) Temperature Loss is determined as a function of maximum gross load, Gross MW, desired reheat temperature, and actual reheat temperature.

7. A system according to claim 3, wherein said Superheat (SH) Spray Flow Loss is determined as a function of baseline heat rate, maximum superheat steam flow, superheat steam flow, and superheat spray flow.

8. A system according to claim 3, wherein said Reheat (RH) Spray Flow Loss is determined as a function of baseline heat rate maximum superheat steam flow, superheat steam flow, and reheat spray flow.

9. A system according to claim 3, wherein said Auxiliary Power Energy Loss is determined as a function of total mill amps, mill volts, total forced draft fan amps, forced draft fan volts, total induced draft fan amps, and induced draft fan volts.

10. A system according to claim 3, wherein said Carbon Loss is determined as a function of % Ash in fuel, carbon in bottom ash (percent), fly ash in total ash (percent), carbon in fly ash (percent), high heat value, gross MW, and fuel flow.

11. A system according to claim 1, wherein said combustion optimization system optimizes a combustion process by providing optimal flows, temperatures and distributions of at least one of air and fuel.

12. A system according to claim 1, wherein said combustion optimization system determines an optimal configuration of the steam generation system that maximizes reduction in said controllable loss components.

13. A system according to claim 1, wherein said system further comprises:

means for outputting the efficiency reference index to a neural network.

14. A system according to claim 1, wherein said system further comprises:

means for outputting the efficiency reference index to a distributed control system of the steam generation system, said distributed control system controlling operation of system devices for the steam generation system.

15. A system according to claim 1, wherein said system further comprises:

means for comparing computed efficiency reference index values associated with multiple steam generation systems.

16. A method for determining performance characteristics of a combustion heating process in a steam generation system, the method comprising:

receiving input data associated with controllable input parameters of a steam generation system, wherein the controllable input parameters are parameters controlled by at least one of (1) an operator of the combustion heating process and (2) a computer control system;

determining a plurality of controllable loss components using the input data associated with the controllable input parameters;

determining an efficiency reference index by summing said plurality of controllable loss components; and outputting the efficiency reference index to a combustion optimization system, wherein the combustion optimization system uses the efficiency reference index to determine optimized control values for optimizing the combustion heating process.

17. A method according to claim 16, wherein said input data associated with the controllable input parameters is selected from the group consisting of:

% carbon in fuel, % hydrogen in fuel, % oxygen in fuel, % nitrogen in fuel, % sulfur in fuel, % ash in fuel, % water in fuel, carbon in bottom ash (percent), fly ash in total ash (percent), carbon in fly ash (percent), measured $O_2$ (percent), $O_2$ measurement as wet or dry basis, absolute humidity, air preheater flue gas outlet temperature, ambient temperature, higher heating value, gross mw, fuel flow, max gross load, desired superheat temperature, actual superheat temperature, desired reheat temperature, actual reheat temperature, baseline heat rate, maximum steam flow, superheat steam flow, superheat spray flow, reheat spray flow, total mill amperage, mill volts, total forced draft fan amperage, forced draft fan volts, total induced draft fan amperage, and induced draft fan volts.

18. A method according to claim 16, wherein said plurality of controllable loss components are selected from the group consisting of: Dry Gas Loss, Superheat (SH) Temperature Loss/Credit, Reheat (RH) Temperature Loss/Credit, Superheat (SH) Spray Flow Loss, Reheat (RH) Spray Flow Loss, Auxiliary Power Energy Loss, and Carbon Loss.

19. A method according to claim 18, wherein said dry gas loss is determined as a function of % carbon in fuel, % hydrogen in, % oxygen in fuel, % nitrogen in fuel, % sulfur in fuel, % ash in fuel, % water in fuel, carbon in bottom ash (percent), fly ash in total ash (percent), carbon in fly ash (percent), measured $0_2$ (percent), $0_2$ measurement as wet or dry basis, humidity, air preheater out temperature, ambient temperature, higher heating value, gross MW, and fuel flow.

20. A method according to claim 19, wherein said Dry Gas Loss is determined by the steps comprising:

calculating an Adjusted Effective Carbon Fraction Burned;

calculating an amount of $O_2$ required to produce a "zero excess air" condition;

using an iterative calculation to determine an amount of $O_2$ in flue gas at a measured excess $O_2$ level;

calculating an actual flue gas composition by volume for a measured and a reference $O_2$ level;

calculating individual "dry" and "wet" component losses on a per component basis; and summing individual "dry" component losses to produce a dry gas loss value.

21. A method according to claim 18, wherein said Superheat (SH) Temperature Loss/Credit is determined as a function of Max Gross Load, gross MW desired superheat temperature, and actual superheat temperature.

22. A method according to claim 21, wherein said Superheat (SH) Temperature Loss/Credit is determined by the steps comprising:

calculating a load factor;

calculating a Superheat (SH) temperature deviation factor; and calculating a Loss/Credit fraction.

23. A method according to claim 18, wherein said Reheat (RH) Temperature Loss/Credit is determined as a function of maximum gross load, gross MW, desired reheat temperature, and actual reheat temperature.

24. A method according to claim 23, wherein said Reheat (RH) Temperature Loss/Credit is determined by the steps comprising:

calculating a load factor;

calculating a Reheat (RH) temperature deviation factor; and calculating a Loss/Credit fraction.

25. A method according to claim 18, wherein said Superheat (SH) Spray Flow Loss is determined as a function of baseline heat rate, maximum superheat steam flow, superheat steam flow, and superheat spray flow.

26. A method according to claim 25, wherein said Superheat (SH) Spray Flow Loss is determined by the steps comprising:

calculating a percent maximum throttle flow; and calculating a percent spray flow of the main steam flow.

27. A method according to claim 18, wherein said Reheat (RH) Spray Flow Loss is determined as a function of baseline heat rate, maximum superheat steam flow, superheat steam flow, and reheat spray flow.

28. A method according to claim 27, wherein said Reheat (RH) Spray Flow Loss is determined by the steps comprising:

calculating a percent maximum reheat steam flow; and calculating a percent spray flow of the reheat steam flow.

29. A method according to claim 18, wherein said Auxiliary Power Energy Loss is determined as a function of total mill amps, mill volts, total forced draft fan amps, forced draft fan volts, total induced draft fan amps, and induced draft fan volts.

30. A method according to claim 29, wherein said Auxiliary Power Energy Loss is determined by the steps comprising:

calculating power consumed by each motor; and calculating a single motor power value for all of the motors.

31. A method according to claim 18, wherein said Carbon Loss is determined as a function of % Ash in fuel, carbon in bottom ash (percent), fly ash in total ash (percent), carbon in fly ash (percent), high heat value, gross MW, and fuel flow.

32. A method according to claim 31, wherein said Carbon Loss is determined by the steps comprising:

calculating an unburned carbon fraction; and calculating unburned carbon loss.

33. A method according to claim 16, wherein said combustion optimization system optimizes a combustion process by providing optimal flows, temperatures and distributions of at least one of air and fuel.

34. A method according to claim 33, wherein said combustion optimization system determines an optimal configuration of the steam generation system that maximizes reduction in said controllable loss components.

35. A method according to claim 16, wherein said method further comprises:

outputting the efficiency reference index to a neural network.

36. A method according to claim 16, wherein said method further comprises:

outputting the efficiency reference index to a distributed control system of the steam generation system, said distributed control system controlling operation of system devices for the steam generation system.

37. A method according to claim 16, wherein said method further comprises:

comparing a plurality of computed efficiency reference index values associated with multiple steam generation systems.

38. An operating system for an electric power generating plant using a combustion heating process to produce steam, the system comprising:

a distributed control system for controlling operation of system devices of the electric power generating plant;

a combustion optimization system, in communication with the distributed control system, for optimizing the combustion heating process by determining optimized control values, said optimized control values output to the distributed control system; and a performance calculation system, in communication with the combustion optimization system, for determining an efficiency reference index indicative of the efficiency of the combustion heating process, said performance calculation system including:

means for receiving input data associated with controllable input parameters of electric power generating plant, wherein said controllable input parameters are parameters that are controlled by at least one of (1) an operator of the combustion heating process and (2) a computer control system;

means for determining a plurality of controllable loss components using the input data associated with the controllable input parameters, said controllable loss components determined in accordance with said received input data; and means for determining an efficiency reference index by summing said plurality of controllable loss components; and means for outputting the determined efficiency reference index to the combustion optimization system, wherein the combustion optimization system uses the efficiency reference index in determining the optimized control values.

* * * * *